US007314994B2

(12) United States Patent
Hull et al.

(10) Patent No.: US 7,314,994 B2
(45) Date of Patent: Jan. 1, 2008

(54) MUSIC PROCESSING PRINTER

(75) Inventors: Jonathan J. Hull, San Carlos, CA (US); Jamey Graham, San Jose, CA (US); Peter E. Hart, Menlo Park, CA (US)

(73) Assignee: Ricoh Company, Ltd., Tokyo (JP)

( * ) Notice: Subject to any disclaimer, the term of this patent is extended or adjusted under 35 U.S.C. 154(b) by 352 days.

(21) Appl. No.: 10/813,849

(22) Filed: Mar. 30, 2004

(65) Prior Publication Data

US 2005/0005760 A1 Jan. 13, 2005

Related U.S. Application Data

(63) Continuation-in-part of application No. 10/645,821, filed on Aug. 20, 2003, and a continuation-in-part of application No. 10/175,540, filed on Jun. 18, 2002, and a continuation-in-part of application No. 10/001,895, filed on Nov. 19, 2001, and a continuation-in-part of application No. 10/001,894, filed on Nov. 19, 2001, now Pat. No. 7,149,957, and a continuation-in-part of application No. 10/001,893, filed on Nov. 19, 2001, and a continuation-in-part of application No. 10/001,891, filed on Nov. 19, 2001, and a continuation-in-part of application No. 10/001,849, filed on Nov. 19, 2001.

(60) Provisional application No. 60/506,303, filed on Sep. 25, 2003, provisional application No. 60/506,302, filed on Sep. 25, 2003.

(51) Int. Cl.
*G10H 7/00* (2006.01)

(52) U.S. Cl. ..... 84/645; 84/615; 84/619; 84/653; 84/657

(58) Field of Classification Search ..... None
See application file for complete search history.

(56) References Cited

U.S. PATENT DOCUMENTS 4,133,007 A 1/1979 Wessler et al.

(Continued)

FOREIGN PATENT DOCUMENTS

| | | |
|---|---|---|
| CN | 1352765 A | 6/2002 |
| CN | 1097394 C | 12/2002 |
| EP | 1133170 A2 | 9/2001 |
| WO | WO 99/18523 | 4/1999 |

OTHER PUBLICATIONS

Gopal, S. et al., "Load Balancing in a Heterogeneous Computing Environment," Proceedings of the Thirty-First Hawaii International Conference on System Sciences, Jan. 6-9, 1998.

(Continued)

*Primary Examiner*—Marlon Fletcher
(74) *Attorney, Agent, or Firm*—Fenwick & West LLP

(57) ABSTRACT

An audio processing device receives, processes, and outputs music and audio files to a variety of electronic and paper-based formats. In one embodiment, the audio processing device generates a score based on a music or audio file, and/or can match the file to melodies stored in a pre-existing database. In an embodiment, the audio processing device and a PC share the processing load. In yet another embodiment, the musical segments identified in a score are mapped to an audio or music file so that a user can access the specific segments at a later point.

42 Claims, 6 Drawing Sheets

U.S. PATENT DOCUMENTS 4,205,780 A 6/1980 Burns et al.
4,635,132 A 1/1987 Nakamura
4,734,898 A 3/1988 Morinaga
4,754,485 A 6/1988 Klatt
4,807,186 A 2/1989 Ohnishi et al.
4,881,135 A 11/1989 Heilweil
4,907,973 A 3/1990 Hon
4,998,215 A 3/1991 Black et al.
5,091,948 A 2/1992 Kametani
5,093,730 A 3/1992 Ishii et al.
5,115,967 A 5/1992 Wedekind
5,136,563 A 8/1992 Takemasa et al.
5,170,935 A 12/1992 Federspiel et al.
5,270,989 A 12/1993 Kimura
5,386,510 A 1/1995 Jacobs
5,432,532 A 7/1995 Mochimaru et al.
5,436,792 A 7/1995 Leman et al.
5,438,426 A 8/1995 Miake et al.
5,444,476 A 8/1995 Conway
5,493,409 A 2/1996 Maeda et al.
5,568,406 A 10/1996 Gerber
5,633,723 A 5/1997 Sugiyama et al.
5,661,783 A 8/1997 Assis
5,682,330 A 10/1997 Seaman et al.
5,690,496 A 11/1997 Kennedy
5,721,883 A 2/1998 Katsuo et al.
5,729,665 A 3/1998 Gauthier
5,764,368 A 6/1998 Shibaki et al.
5,774,260 A 6/1998 Petitto et al.
5,884,056 A 3/1999 Steele
5,903,538 A 5/1999 Fujita et al.
5,936,542 A 8/1999 Kleinrock et al.
5,940,776 A 8/1999 Baron et al.
5,987,226 A 11/1999 Ishikawa et al.
6,000,030 A 12/1999 Steinberg et al.
6,106,457 A 8/2000 Perkins et al.
6,115,718 A 9/2000 Huberman et al.
6,118,888 A 9/2000 Chino et al.
6,138,151 A 10/2000 Reber et al.
6,153,667 A 11/2000 Howald
6,170,007 B1 1/2001 Venkatraman et al.
6,175,489 B1 1/2001 Markow et al.
6,189,009 B1 2/2001 Stratigos et al.
6,193,658 B1 2/2001 Wendelken et al.
6,296,693 B1 10/2001 McCarthy
6,297,851 B1 10/2001 Taubman et al.
6,298,145 B1 10/2001 Zhang et al.
6,302,527 B1 10/2001 Walker
6,308,887 B1 10/2001 Korman et al.
6,373,498 B1 4/2002 Abgrall
6,373,585 B1 4/2002 Mastie et al.
6,375,298 B2 4/2002 Purcell et al.
6,378,070 B1 4/2002 Chan et al.
6,417,435 B2 * 7/2002 Chantzis et al. ..... 84/477 R
6,421,738 B1 7/2002 Ratan et al.
6,439,465 B1 8/2002 Bloomberg
6,442,336 B1 8/2002 Lemelson
6,452,615 B1 9/2002 Chiu et al.
6,466,534 B2 10/2002 Cundiff, Sr.
6,476,793 B1 11/2002 Motoyama et al.
D468,277 S 1/2003 Sugiyama
6,519,360 B1 2/2003 Tanaka
6,529,920 B1 3/2003 Arons et al.
6,535,639 B1 3/2003 Uchihachi et al.
6,552,743 B1 4/2003 Rissman
6,594,377 B1 7/2003 Kim et al.
6,611,276 B1 8/2003 Muratori et al.
6,611,622 B1 8/2003 Krumm
6,611,628 B1 8/2003 Sekiguchi et al.
6,647,535 B1 11/2003 Bozdagi et al.
6,665,092 B2 12/2003 Reed
6,674,538 B2 1/2004 Takahashi
6,678,389 B1 1/2004 Sun et al.
6,687,383 B1 2/2004 Kanevsky et al.
6,700,566 B2 3/2004 Shimoosawa et al.
6,724,494 B1 4/2004 Danknick
6,750,978 B1 6/2004 Marggraff et al.
6,774,951 B2 8/2004 Narushima
6,775,651 B1 8/2004 Lewis et al.
6,807,303 B1 10/2004 Kim et al.
6,824,044 B1 11/2004 Lapstun et al.
6,856,415 B1 2/2005 Simchik et al.
6,892,193 B2 5/2005 Bolle et al.
6,938,202 B1 8/2005 Matsubayashi et al.
6,964,374 B1 11/2005 Djuknic et al.
6,983,482 B2 1/2006 Morita et al.
7,000,193 B1 2/2006 Impink, Jr. et al.
7,023,459 B2 4/2006 Arndt et al.
7,031,965 B1 4/2006 Moriya et al.
7,075,676 B2 7/2006 Owen
7,131,058 B1 10/2006 Lapstun et al.
2001/0003846 A1 6/2001 Rowe et al.
2001/0017714 A1 8/2001 Komatsu et al.
2001/0037408 A1 11/2001 Thrift et al.
2001/0052942 A1 12/2001 MacCollum et al.
2002/0001101 A1 1/2002 Hamura et al.
2002/0004807 A1 1/2002 Graham et al.
2002/0006100 A1 1/2002 Cundiff, Sr. et al.
2002/0010641 A1 1/2002 Stevens et al.
2002/0015066 A1 2/2002 Siwinski et al.
2002/0048224 A1 4/2002 Dygert et al.
2002/0060748 A1 5/2002 Aratani et al.
2002/0067503 A1 6/2002 Hiatt
2002/0099534 A1 7/2002 Hegarty
2002/0101513 A1 8/2002 Halverson
2002/0131071 A1 9/2002 Parry
2002/0135800 A1 9/2002 Dutta
2002/0140993 A1 10/2002 Silverbrook
2002/0159637 A1 10/2002 Echigo et al.
2002/0169849 A1 11/2002 Schroath
2002/0171857 A1 11/2002 Hisatomi et al.
2002/0185533 A1 12/2002 Shieh et al.
2002/0199149 A1 12/2002 Nagasaki et al.
2003/0002068 A1 1/2003 Constantin et al.
2003/0007776 A1 1/2003 Kameyama et al.
2003/0038971 A1 2/2003 Renda
2003/0051214 A1 3/2003 Graham et al.
2003/0084462 A1 5/2003 Kubota et al.
2003/0088582 A1 5/2003 Pflug
2003/0093384 A1 5/2003 Durst et al.
2003/0110926 A1 * 6/2003 Sitrick et al. ..... 84/477 R
2003/0117652 A1 6/2003 Lapstun
2003/0121006 A1 6/2003 Tabata et al.
2003/0160898 A1 8/2003 Baek et al.
2003/0220988 A1 11/2003 Hymel
2004/0044894 A1 3/2004 Lofgren et al.
2004/0125402 A1 7/2004 Kanai et al.
2004/0128613 A1 7/2004 Sinisi
2004/0143602 A1 7/2004 Ruiz et al.
2004/0240541 A1 12/2004 Chadwick et al.
2004/0249650 A1 12/2004 Freedman et al.
2005/0064935 A1 3/2005 Blanco
2007/0033419 A1 2/2007 Kocher et al.

OTHER PUBLICATIONS

Gropp, W. et al., "Using MPI—Portable Programming with the Message-Passing Interface," copyright 1999, pp. 35-42, second edition, MIT Press.

"Seiko Instruments USA, Inc.—Business and Home Office Products" online, date unknown, Seiko Instruments USA, Inc., [retrieved on Jan. 25, 2005]. Retrieved from the Internet: <URL: http://www.siibusinessproducts.com/products/link-ir-p-html>.

"Tasty FotoArt" [online], date unknown, Tague Technologies, Inc., [retrieved on Mar. 8, 3005]. Retrieved from the Internet: <URL: http//www.tastyfotoart.com>.
ASCII 24.com, [online] (date unknown), Retrieved from the Internet<URL: http://216.239.37.104/search?q=cache:z-G9M1EpvSUJ:ascii24.com/news/i/hard/article/1998/10/01/612952-000.html+%E3%82%B9%E3%...>.
Configuring A Printer (NT), Oxford Computer Support [online] [Retrieved on Nov. 13, 2003] Retrieved from the Internet<URL: http://www.nox.ac.uk/cehoxford/ccs/facilities/printers/confignt.htm>.
"DocumentMall Secure Document Management" [online] [Retrieved on Mar. 9, 2004]. Retrieved from the Internet <URL: http://www.documentmall.com>.
Girgensohn, Andreas et al., "Time-Constrained Keyframe Selection Technique," Multimedia Tools and Applications (2000), vol. 11, pp. 347-358.
Graham, Jamey et al., "A Paper-Based Interface for Video Browsing and Retrieval," IEEE International Conference on Multimedia and Expo (Jul. 6-9, 2003), vol. 2, P:II 749-752.
Graham, Jamey et al., "The Video Paper Multimedia Playback System," Proceedings of the 11th ACM International Conference on Multimedia (Nov. 2003), pp. 94-95.
Graham, Jamey et al., "Video Paper: A Paper-Based Interface for Skimming and Watching Video," International Conference on Consumer Electronics (Jun. 16-18, 2002), pp. 214-215.
Hull, Jonathan J. et al., "Visualizing Multimedia Content on Paper Documents: Components of Key Frame Selection for Video Paper," Proceedings of the 7th International Conference on Document Analysis and Recognition (2003), vol. 1, pp. 389-392.
"Kofax: Ascent Capture: Overview" [online] [Retrieved on Jan. 22, 2004]. Retrieved form the Internet: <URL http://www.kofax.com/products/ascent/capture>.
Label Producer by Maxell, [online] [Retrieved on Nov. 11, 2003]. Retrieved from the Internet<URL: http://www.maxell.co.jp/products/consumer/rabel_card/>.
Movie-PhotoPrint by Canon, [online] [Retrieved on Nov. 11, 2003]. Retrieved from the Internet<URL: http://cweb.canon.jp/hps/guide/rimless.html>.
PostScript Language Document Structuring Conventions Specification, Version 3.0 (Sep. 25, 1992), Adobe Systems Incorporated.
Print From Cellular Phone by Canon, [online] [Retrieved on Nov. 11, 2003]. Retrieved from the Internet<URL: http://cweb.canon.jp/bj/enjoy/pbeam/index.html>.
Print Images Plus Barcode by Fuji Xerox, [online] [Retrieved on Nov. 11, 2003]. Retrieved from the Internet<URL: http://www.fujixerox.co.jp/soft/cardgear/release.html>.
Print Scan-Talk By Barcode by Epson, [online] [Retrieved on Nov. 11, 2003]. Retrieved from the Internet<URL: http://www.epson.co.jp/osirase/2000/000217.htm>.
Printer With CD/DVD Tray, Print CD/DVD Label by Epson, [online] [Retrieved on Nov. 11, 2003]. Retrieved from the Internet<URL: http://www.i-love-epson.co.jp/products/printer/inkjet/pmd750/pmd7503.htm>.
R200 ScanTalk [online] (date unknown). Retrieved from the Internet<URL: http://homepage2.nifty.com/vasolza/ScanTalk.htm>.
Variety of Media In, Print Paper Out by Epson, [online] [Retrieved on Nov. 11, 2003]. Retrieved from the Internet<URL: http://www.i-love-epson.co.jp/products/spc/pma850/pma8503.htm>.
Dimitrova, N. et al., "Applications of Video-Content Analysis and Retrieval," IEEE Multimedia, Jul.-Sep. 2002, pp. 42-55.
European Search Report, EP 04255836, Sep. 12, 2006, 4 pages.
European Search Report, EP 04255837, Sep. 5, 2006, 3 pages.
European Search Report, EP 04255839, Sep. 4, 2006, 3 pages.
European Search Report, EP 04255840, Sep. 12, 2006, 3 pages.
Graham, J. et al., "A Paper-Based Interface for Video Browsing and Retrieval," ICME '03, Jul. 6-9, 2003, pp. 749-752, vol. 2.
Graham, J. et al., "Video Paper: A Paper-Based Interface for Skimming and Watching Video," ICCE '02, Jun. 18-20, 2002, pp. 214-215.
Klemmer, S.R. et al., "Books With Voices: Paper Transcripts as a Tangible Interface to Oral Histories," CHI Letters, Apr. 5-10, 2003, pp. 89-96, vol. 5, Issue 1.
Minami, K. et al., "Video Handling with Music and Speech Detection," IEEE Multimedia, Jul.-Sep. 1998, pp. 17-25.
Shahraray, B. et al, "Automated Authoring of Hypermedia Documents of Video Programs," ACM Multimedia '95 Electronic Proceedings, San Francisco CA, Nov. 5-9, 1995 pp. 1-12.
Shahraray, B. et al., "Pictorial Transcripts: Multimedia Processing Applied to Digital Library Creation," IEEE, 1997, pp. 581-586.
Poon, K.M. et al., "Performance Analysis of Median Filtering on Meiko™—A Distributed Multiprocessor System," IEEE First International Conference on Algorithms and Architectures for Parallel Processing, 1995, pp. 631-639.
ASCII 24.com,[online] (date unknown), Retrieved from the Internet<URL: http://216.239.37.104/search?q=cache:z-G9M1EpvSUJ:ascii24.com/news/i/hard/article/1998/10/01/612952-000.html+%E3%82%B9%E3%. . . >.
Label Producer by Maxell, [online] [Retrieved on Nov. 11, 2003]. Retrieved from the Internet<URL: http://www.maxell.co.jp/products/consumer/rabel_card/>.
Lamming, M. et al., "Using Automatically Generated Descriptions of Human Activity to Index Multi-media Data," IEEE Multimedia Communications and Applications IEE Colloquium, Feb. 7, 1991, pp. 5/1-5/3.
Movie-PhotoPrint by Canon, [online] [Retrieved on Nov. 11, 2003]. Retrieved from the Internet<URL: http://cweb.canon.ip/hps/guide/rimless.html>.
Print from Cellular Phone by Canon, [online] [Retrieved on Nov. 11, 2003]. Retrieved from the Internet<URL:http://cweb.canon.jp/bj/enjoy/pbeam/index.html>.
Print Images Plus Barcode by Fuji Xerox, [online] [Retrieved on Nov. 11, 2003]. Retrieved from the Internet<URL: http://www.fujixerox.co.jp/soft/cardgear/release.html>.
Print Scan-Talk by Barcode by Epson, [online] [Retrieved on Nov. 11, 2003]. Retrieved from the Internet<URL: http://www.epson.co.jp/osirase/2000/000217.htm>.
Printer with CD/DVD Tray, Print CD/DVD Label by Epson, [online] [Retrieved on Nov. 11, 2003]. Retrieved from the Internet<URL: http://www.i-love-epson.co.jp/products/printer/inkjet/pmd750/pmd7503.htm>.
Variety of Media In, Print Paper Out by Epson, [online] [Retrieved on Nov. 11, 2003]. Retrieved from the Internet<URL: http://www.i-love-epson.co.jp/products/spc/pma850/pma8503,htm>.
Chinese Application No. 2004100849823 Office Action, Jun. 1, 2007, 24 pages.
Chinese Application No. 2004100897988 Office Action, Apr. 6, 2007, 8 pages.
Gropp, W. et al., "Using MPI-Portable Programming with the Message Passing Interface," copyright 1999, pp. 35-42, second edition, MIT Press.
Gopal, S. et al., "Load Balancing in a Heterogeneous Computing Environment," Proceedings of the Thirty-First Hawaii International Conference on System Sciences, Jan. 6-9, 1998.
Gropp, W. et al., "Using MPI—Portable Programming with the Message-Passing Interface," copyright 1999, pp. 35-42, second edition, MIT Press.
"Seiko Instruments USA, Inc.-Business and Home Office Products" online, date unknown, Seiko Instruments USA, Inc., [retrieved on Jan. 25, 2005] Retrieved from the Internet: <http://www.siibusinessproducts.com/products/link-ir-p-html>.
"Tasty FotoArt" [online], date unknown, Tague Technologies, Inc., [retrieved on Mar. 8, 3005]. Retrieved from the Internet: <http://www.tastyfotoart.com>.
Stifelman, L. et al., "The Audio Notebook," SIGCHI 2001, Mar. 31-Apr. 5, 2001, pp. 182-189, vol. 3, No. 1, Seattle, WA.
Communication Pursuant to Article 96(2) EPC, European Application No. 04255836.1, Jun. 11, 2007, 10 pages.

* cited by examiner

MUSIC PROCESSING PRINTER

CROSS REFERENCE TO RELATED APPLICATIONS

The present application claims the benefit of U.S. Provisional Patent Application Ser. No. 60/506,303 filed Sep. 25, 2003, entitled "Printer Including One or More Specialized Hardware Devices," and U.S. Provisional Patent Application 60/506,302 filed on Sep. 25, 2003, entitled "Printer Including Interface and Specialized Information Processing Capabilities," each of which is hereby incorporated by reference in its entirety.

The present application is a continuation-in-part of the following U.S. Patent Applications: application Ser. No. 10/001,895, "(Video Paper) Paper-based Interface for Multimedia Information," filed Nov. 19, 2001; application Ser. No. 10/001,849, "(Video Paper) Techniques for Annotating Multimedia Information," filed Nov. 19, 2001; application Ser. No. 10/001,893, "(Video Paper) Techniques for Generating a Coversheet for a paper-based Interface for Multimedia Information," filed Nov. 19, 2001; application Ser. No. 10/001,894 now U.S. Pat. No. 7,149,957, "(Video Paper) Techniques for Retrieving Multimedia Information Using a Paper-Based Interface," filed Nov. 19, 2001; application Ser. No. 10/001,891, "(Video Paper) Paper-based Interface for Multimedia Information Stored by Multiple Multimedia Documents," filed Nov. 19, 2001; application Ser. No. 10/175,540, "(Video Paper) Device for Generating a Multimedia Paper Document," filed Jun. 18, 2002; and application Ser. No. 10/645,821, "(Video Paper) Paper-Based Interface for Specifying Ranges CIP," filed Aug. 20, 2003; each of which is each hereby incorporated by reference in its entirety.

The present application is related to the following U.S. Patent Aplications: "Printer Having Embedded Functionality for Printing Time-Based Media," to Hart et. al, filed Mar. 30, 2004, "Networked Printing System Having Embedded Functionality for Printing Time-Based Media," to Hart et. al, filed Mar. 30, 2004, and "Multimedia Print Driver Dialog Interfaces," to Hull et. al, filed Mar. 30, 2004, each of which is hereby incorporated by reference in its entirety.

BACKGROUND

1. Field of the Invention

The present invention relates to printing devices and, more specifically, to printing devices that can receive music files, generate and deliver a variety of music-related paper and electronic outputs.

2. Background of the Invention

Advances in audio technology have created new opportunities for musicians, composers, and music lovers to play, create, and appreciate music. At the forefront of these advances has been the advent of MPEG audio layer 3 ("MP3") and related standards for compressing digital audio files. The ability to reduce music files to a fraction of their original size has enabled the sharing of literally millions of music and other audio files through peer-to-peer networks. While MP3 and other digital audio formats are well-suited for providing studio quality recordings, there is still a strong demand for other types of musical files—for instance musical scores and Musical Instruments Digital Interface (MIDI) files.

Scores and MIDI files are particularly useful for composing or writing music. Oftentimes, composers will score a musical work or idea soon after its creation, and then refine the score as the music develops. MIDI files, because of their small size and ease of manipulation, are likewise well-suited to composing, editing, and arranging music. MIDI files are also better adapted than MP3s for applications constrained by memory limitations. Cellphones, PDAs, and other handheld devices often use MIDI tones as signal tones, as do website interfaces and games, in place of bulkier digital audio files. In addition, both musical scores and MIDI files often store musical information embedded in finished recordings such as the tempo, phrasing, measures, or stanzas of a piece, or when a note is played, how loudly, and for how long. This information can be useful in marking and indexing finished recordings.

Presently, the conversion of audio and music files between different paper, digital and analog formats often requires several steps and devices. To convert an analog recording into a digital file such as an MP3, and then output versions of the MP3 as a musical score and a MIDI file that can be played as a cellphone ringtone requires coordination between different systems and outputs.

Thus, there is a need for a unified system that can translate audio files into different types of paper and electronic file formats and output the results.

SUMMARY OF THE INVENTION

The present invention overcomes the deficiencies and limitations of the prior art by allowing users to convert and print their music and audio files to various paper and electronic media. In accordance with an embodiment of the invention, a user can send an audio or music file in a first format to an audio processing device, and then receive an output of the file in a second format. In another embodiment, an audio processing device receives a musical score and a music file and indexes the contents of the musical file according to positions in the musical score. In an embodiment, there is an apparatus for outputting a processed audio/music file. The apparatus comprises an interface for receiving audio/music data in a first format, a processor for processing the audio/music data, and an output system for outputting the processed audio/music data in a second format.

DETAILED DESCRIPTION OF THE PREFERRED EMBODIMENTS

Figure 1:
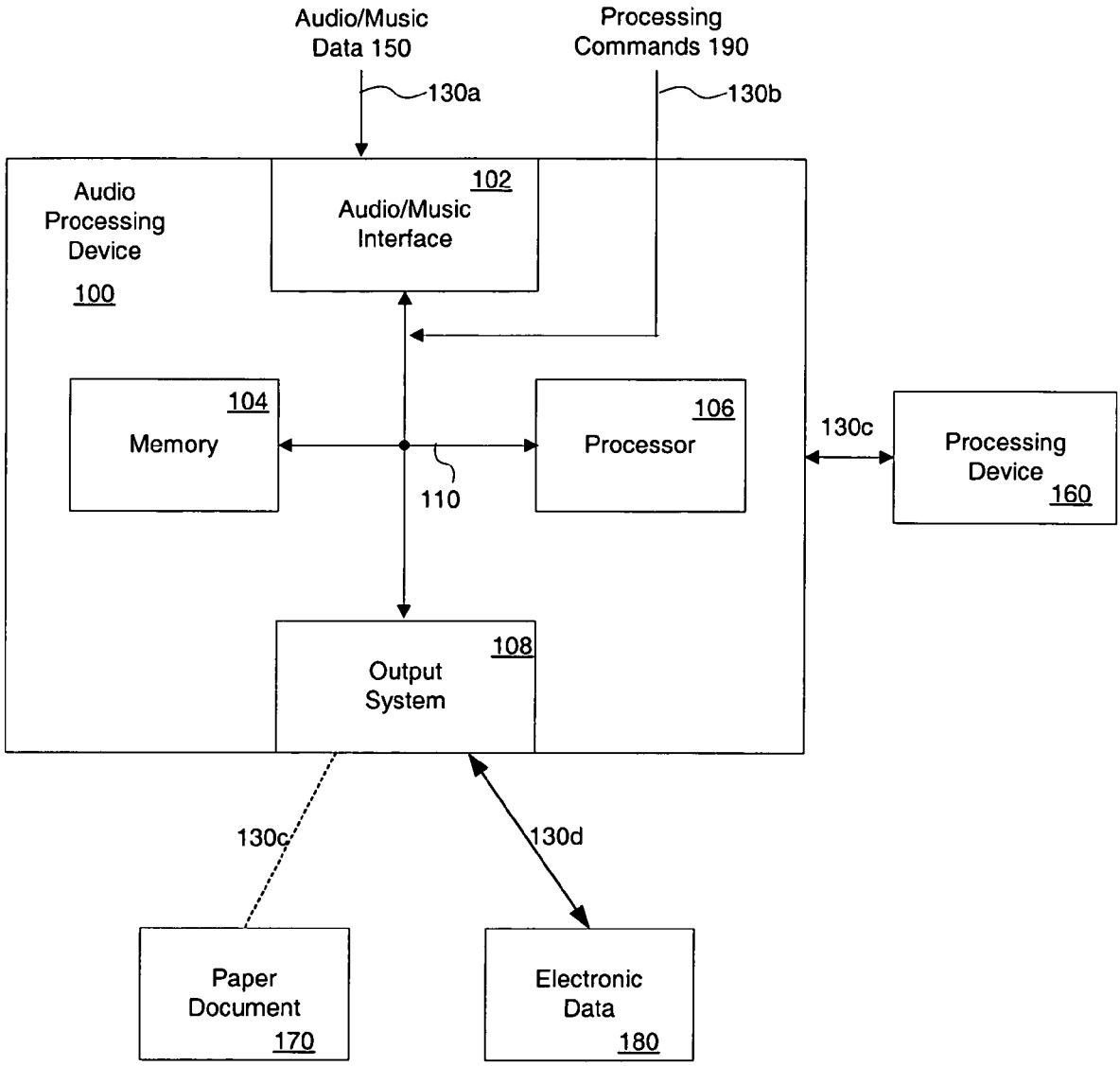
FIG. 1 is a block diagram showing an audio processing device in accordance with an embodiment of the invention.

The invention provides various apparati and methods for processing audio files to generate a variety of outputs. In one embodiment, a digital audio file is provided to an audio processing device 100, converted into a MIDI file and then scored, and the resulting audio record is printed out. In another, several versions of a music file are provided to audio processing device, and information contained in one version is used to create an index to another version. In yet another embodiment, commands to edit and output an audio file are received by a printer, carried out, and the result may be output to a storage media or network server. In a still further embodiment, a processed audio file is broadcast over a playback device installed on a printer or audio processing device 100 that receives the audio file in unprocessed form over a network.

Allowing a user to manage audio and music file conversions with the use of embodiments of the invention offers several benefits. First, converting audio data to smaller MIDI or paper-based format makes it easier to manipulate the data. In addition, the burdens associated with comparing and matching audio files and identifying patterns within the files may be facilitated by the automatic conversion of the files into the appropriate format. Finally, the indexing of audio files based on musical segments made possible by embodiments of the invention facilitates access to specific portions of an audio file.

For the purposes of this invention, the terms "audio/music data", "audio/music file", "audio/music information" or "audio/music content" refers to any one of or a combination of audio or music data. As used herein, the terms "audio data", "audio files", "audio information" or "audio content" refer to data containing speech, recordings, sounds, MIDI data, or music. The data can be in analog form, stored on magnetic tape, or digital files that can be in a variety of formats including MIDI, .mp3, or .wav. Audio data may comprise the audio portion of a larger file, for instance a multimedia file with audio and video components. As used herein, the terms "music files", "music data", "music information" or "music content" means audio data that contains music or melodies, rather than pure sounds or speech, and representations of such data including music scores or other musical map. Music files can comprise audio data that conveys such music or melodies. Music files alternatively can be conveyed for instance in a document or graphical format such as Postscript, .tiff., .gif, or .jpeg.

For purposes of the invention, the audio/music data discussed throughout the invention can be supplied to audio processing device 100 in any number of ways including in the form of streaming content, a live feed from an audio capture device, a discrete file, or as a portion of a larger file. In addition, for the purposes of this invention, the terms "print" or "printing," when referring to printing onto some type of medium, are intended to include printing, writing, drawing, imprinting, embossing, generating in digital format, and other types of generation of a data representation. While the words "document" and "paper" are referred to in these terms, output of the system in the present invention is not limited to such a physical medium, like a paper medium. Instead, the above terms can refer to any output that is fixed in a tangible medium. In some embodiments, the output of the system 100 of the present invention can be a representation of audio/music data printed on a physical paper document. By generating a paper document, the present invention provides the portability of paper and provides a readable representation of the multimedia information.

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" or the like means that a particular feature, structure, or characteristic described in connection with the embodiment is included in at least one embodiment of the invention. The appearances of "in one embodiment" and like phrases in various places in the specification are not necessarily all referring to the same embodiment.

FIG. 1 is a block diagram showing an audio processing device or music processing printer 100 in accordance with an embodiment of the invention. The audio processing device 100 preferably comprises an audio/music interface 102, a memory 104, a processor 106, and an output system 108.

As shown, in one embodiment, audio/music data 150 is passed through signal line 130*a* coupled to audio processing device 100 to audio/music interface 102 of audio processing device 100. As discussed throughout this application, the term "signal line" means any connection or combination of connections supported by a digital, analog, satellite, wireless, firewire, IEEE 1394, 802.11, RF, local and/or wide area network, Ethernet, 9-pin connector, parallel port, USB, serial, or small computer system interface (SCSI), TCP/IP, HTTP, email, web server, or other communications device, router, or protocol. Audio/music data 150 may be sourced from a portable storage medium (not shown) such as a tape, disk, flash memory, or smart drive, CD-ROM, DVD, or other magnetic, optical, temporary computer, or semiconductor memory. In an embodiment, data 150 are accessed by the audio processing device 100 from a storage medium through various card, disk, or tape readers that may or may not be incorporated into audio processing device 100. Alternatively, audio/music data 150 may be sourced from a peer-to-peer or other network (not shown) coupled to the audio/music interface 102 through signal line 130*a* or received through signal line 130*d*, or audio/music data 150 can be streamed in real-time as they are created to audio/music interface 102.

In an embodiment, audio/music data 150 are received over signal line 130*a* from a data capture device (not shown), such as a microphone, tape recorder, video camera, or other device. Alternatively, the data may be delivered over signal line 130*a* to audio/music interface 102 over a network from a server hosting, for instance, a database of audio/music files. Additionally, the audio/music data may be sourced from a receiver (e.g., a satellite dish or a cable receiver) that is configured to capture or receive (e.g., via a wireless link) audio/music data from an external source (not shown) and then provide the data to audio/music interface 102 over signal line 130*a*.

Audio/music data 150 are received through audio/music interface 102 adapted to receive audio/music data 150 from signal line 130*a*. Audio/music interface 102 may comprise a typical communications port such as a parallel, USB, serial, SCSI, Bluetooth™/IR receiver. It may comprise a disk drive, analog tape reader, scanner, firewire, IEEE 1394, Internet, or other data and/or data communications interface.

Audio/music interface 102 in turn supplies audio/music data 150 or a processed version of it to system bus 110. System bus 110 may represent one or more buses including an industry standard architecture (ISA) bus, a peripheral component interconnect (PCI) bus, a universal serial bus (USB), or some other bus known in the art to provide similar functionality. In an embodiment, if audio/music data 150 is received in an analog form, it is first converted to digital form for processing using a conventional analog-to-digital converter. Likewise, if the audio/music data 150 is a paper input, for instance a paper score, audio/music interface 102 may be coupled to a scanner (not shown) that could be equipped with optical character recognition (OCR) capabilities by which the paper score can be converted to a digital output signal like 130*a*. Audio/music data 150 is sent in digitized form to the system bus 110 of audio processing device 100.

In FIG. 1, audio/music data 150 is delivered over signal line 130*a* to audio processing device 100. However, in other embodiments, audio/music data 150 may also be generated within audio processing device 100 and delivered to processor 106 by system bus 110. For instance, audio/music data 150 may be generated on audio processing device 100 through the use of music generation software (not shown) for composing a MIDI file. Once created on the audio processing device 100, a MIDI file can be sent along the system bus 110, to processor 106 or memory 104 for instance. In another embodiment, audio processing device 100 contains a digital audio recorder (not shown) through which live music played on an instrument or output device outside the audio processing device 100, for instance, can be recorded. Once captured, digital signals comprising the audio recording can then be further processed by the audio processing device 100.

Commands 190 to process or output audio/music data 150 may be transmitted to audio processing device 100 through signal line 130*b* coupled to audio processing device 100. In an embodiment, commands 190 reflect a user's specific conversion, processing, and output preferences. Such commands could include instructions to convert audio/music data 150 from an analog to digital format, or digital to analog, or from one digital format to another, or from a score to music or vice versa. Alternatively, commands 190 could direct processor 106 to carry out a series of conversions, or to index raw or processed audio/music data 150. In an embodiment, commands 190 specify where the processed audio/music data 150 should be output—for instance to a paper document, electronic document, portable storage medium, or the like. A specific set of commands sent over a signal line 130*b* to bus 110 in the form of digital signals instruct, for instance, that audio/music data 150 in a .wav file should be converted to MIDI and then scored, and the result burned to a CD.

Figure 3:
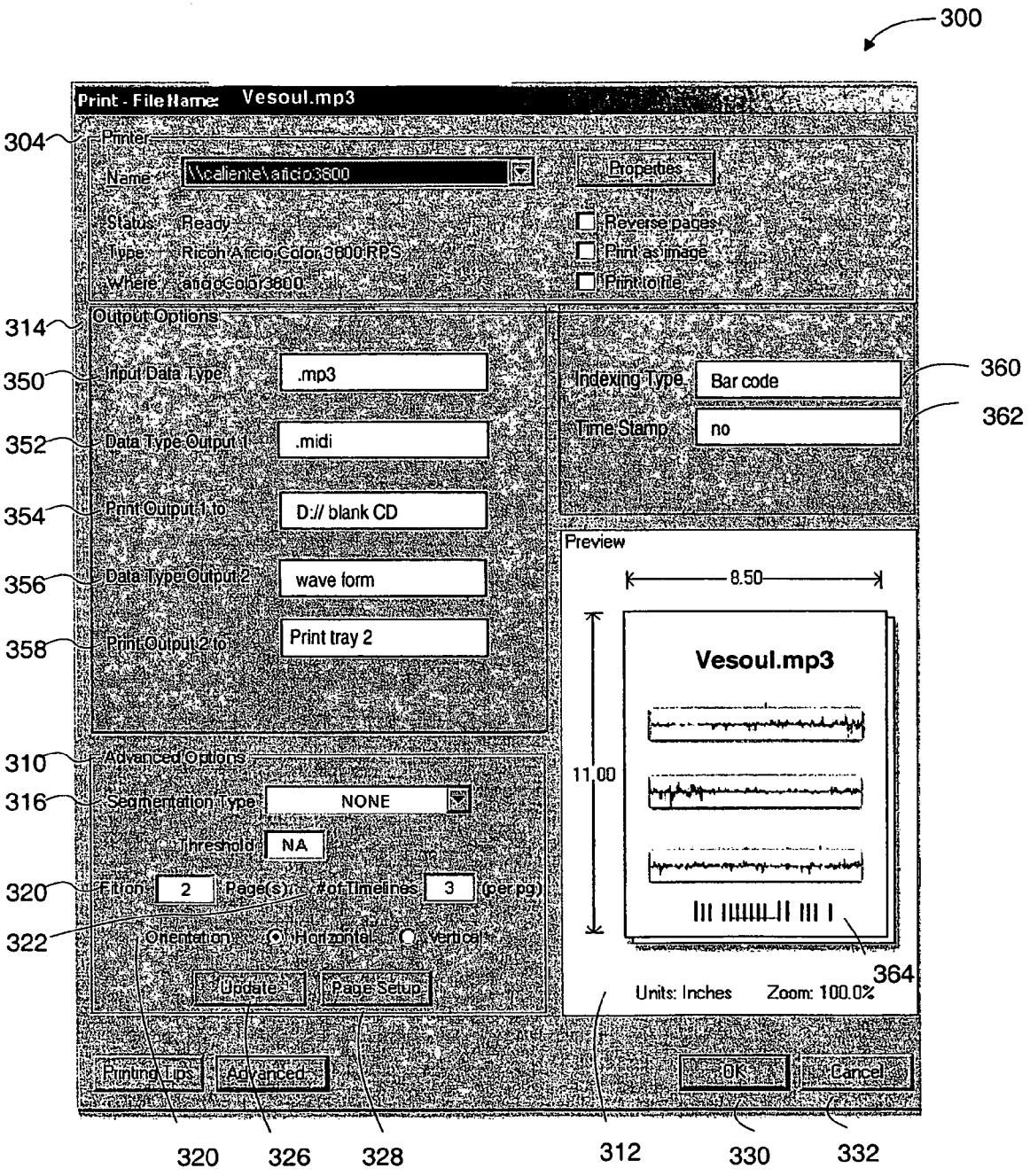
FIG. 3 shows an exemplary print dialog interface for use with an audio processing device.

In an embodiment, commands 190 to processor 106 instruct that the processed audio/music data 150 be output to a paper document. Preferably commands 190 describe the layout of the document 170 on the page, and are sent as digital signals over signal line 130*b* in any number of formats that can be understood by processor 106 including page description language (PDL), Printer Command Language (PCL), graphical device interface (GDI) format, Adobe's Postscript language, or a vector- or bitmap-based language. The instructions 190 also specify the paper source, page format, font, margin, and layout options for the printing to paper of audio/music data 150. Commands 190 could originate from a variety of sources including a print dialog on a processing device 160 coupled to audio processing device 100 by signal line 130*c* that is programmed to appear every time a user attempts to send audio/music data 150 to the audio processing device 100 for instance. FIG. 3 shows one exemplary print dialog interface 300 to be displayed for use with an embodiment of the invention. Alternatively, commands 190 in the form of responses provided by a user to a set of choices presented in a graphical user interface could be sent to processor 106 via a signal line 130*b* or 130*d* and system bus 110 over a network (not shown). A similar set of choices and responses could be presented by a hardware display, for instance through a touch screen or key pad hosted on a peripheral device coupled to audio processing device 100 by a signal line or installed on audio processing device 100. The commands may be transmitted, in turn, to audio processing device 100 through signal line 130*b* connected to the peripheral device or could be directly provided to audio processing device 100. In yet another embodiment, conventional software hosted on a machine (not shown) could be adapted to solicit processing and output choices from a user and then send these to processor 106 on audio processing device 100. This software could be modified through a software plug-in, customized programming, or a driver capable of adding "print" options to audio rendering applications such as Windows Media. Various possible interfaces for controlling and managing audio/music data are further discussed in U.S. Patent Application entitled, "Multimedia Print Driver Dialog Interfaces," to Hull et. al, filed Mar. 30, 2004, which is hereby incorporated by reference in its entirety.

Although processor 106 of audio processing device 100 of FIG. 1 is configured to receive processing commands 190 over a signal line 130*b*, as described above, in another embodiment of the invention, processing commands 190 are input or generated directly on audio processing device 100. In another embodiment, audio processing device 100 does not receive commands at all to process the audio/music data 150, but contains logic that dictates what steps should automatically be carried out in response, for instance, to receiving a certain kind of data 150. For instance, the audio processing device 100 could be programmed to convert every .mp3 or .wav file it receives to MIDI upon receipt, and then to store the resulting MIDI file to a server on a network accessed over signal line 130*d*.

As shown in FIG. 1, audio processing device 100 receives audio/music data 150 and commands 190 over signal lines 130*a*, 130*b* and outputs processed audio/music data 150 over signal line 130*c* as a paper document 170 or over signal line 130*d* as electronic data 180. Audio processing device 100 may be customized for use with audio/music data 150, and may contain various of the modules 200–212 displayed in FIG. 2 and assorted peripherals (such as an electronic keyboard, microphones) (not shown) to generate audio/music data 150. As used herein, the term "module" can refer to program logic for providing the specified functionality that can be implemented in hardware, firmware, and/or software. In an embodiment, audio processing device 100 comprises a printing device that has the capability to generate paper outputs, and may or may not have the ability to generate electronic outputs as shown. As used herein, the term "printing device" or "printer" refers to a device that is capable of receiving audio/music data 150, has the functionality to print paper documents, and may also have the capabilities of a fax machine, a copy machine, and other devices for generating physical documents. Printing device may comprise a conventional laser, inkjet, portable, bubble-jet, handheld, or other printer, or may comprise a multi-purpose printer plus copier, digital sender, printer and scanner, or a specialized photo or portable printer, or other device capable of printing a paper document. In an embodiment, printing device comprises a conventional printer adapted to receive audio data, or to output electronic data.

Audio processing device 100 preferably comprises an output system 108 capable of outputting data in a plurality of data types. For example, output system 108 preferably comprises a printer of a conventional type and a disk drive capable of writing to CDs or DVDs. Output system 108 may compromise a raster image processor or other device or module to render audio/music data 150 onto a paper document 170. In another embodiment, output system 108 may be a printer and one or more interfaces to store data to non-volatile memory such as ROM, programmable read-only memory (PROM), erasable programmable read-only memory (EPROM), electrically erasable programmable read-only memory (EEPROM), flash memory, and random access memory (RAM) powered with a battery. Output system 108 may also be equipped with interfaces to store electronic data 150 to a cell phone memory card, PDA memory card, flash media, memory stick or other portable medium. Later, the output electronic data 180 can be accessed from a specified target device. In an embodiment, output system 108 can also output processed audio/music data 150 over signal line 130*d* to an email attaching the processed audio/music data 150 to a predetermined address via a network interface (not shown). In another embodiment, processed audio/music data 150 is sent over signal line 130*d* to a rendering or implementing device such as a CD player or media player (not shown) where it is broadcast or rendered. In another embodiment, signal line 130*d* comprises a connection such as an Ethernet connection, to a server containing an archive where the processed content can be stored. Other output forms are also possible.

Audio processing device 100 further comprises processor 106 and memory 104. Processor 106 contains logic to perform tasks associated with processing audio/music data 150 signals sent to it through the bus 110. It may comprise various computing architectures including a reduced instruction set computer (RISC) architecture, a complex instruction set computer (CISC) architecture, or an architecture implementing a combination of instruction sets. In an embodiment, processor 106 may be any general-purpose processor such as that found on a PC such as an INTEL ×86, SUN MICROSYSTEMS SPARC, or POWERPC compatible-CPU. Although only a single processor 106 is shown in FIG. 1, multiple processors may be included.

Memory 104 in audio processing device 100 can serve several functions. It may store instructions and associated data that may be executed by processor 106, including software and other components. The instructions and/or data may comprise code for performing any and/or all of the functions described herein. Memory 104 may be a dynamic random access memory (DRAM) device, a static random access memory (SRAM) device, or some other memory device known in the art. Memory 104 may also include a data archive (not shown) for storing audio/music data 150 that has been processed on processor 106. In addition, when audio/music data 150 is first sent to audio processing device 100 110 via signal line 130*a*, the data 150 may temporarily be stored in memory 104 before it is processed. Other modules 200–212 stored in memory 104 may support various functions, for instance to convert, match, score and map audio data. Exemplary modules in accordance with an embodiment of the invention are discussed in detail in the context of FIG. 2, below.

Although in FIG. 1, electronic output 180 is depicted as being sent outside audio processing device 100 over signal line 130*d*, in some embodiments, electronic output 180 remains in audio processing device 100. For instance, processed audio/music data 150 could be stored on a repository (not shown) stored in memory 104 of audio processing device 100, rather than output to external media. In addition, audio processing device 100 may also include a speaker (not shown) or other broadcasting device. An audio card or other audio processing logic may process the audio/music data 150 and send them over bus 110 to be output on the speaker. Not every embodiment of the invention will include an output system 108 for outputting both a paper document 170 and electronic data 180. Some embodiments may include only one or another of these output formats.

Audio processing device 100 of FIG. 1 is configured to communicate with processing device 160. In an embodiment, audio processing device 100 may share or shift the load associated with processing audio/music data 150 with or to processing device 160. Processing device 160 may be a PC, equipped with at least one processor coupled to a bus (not shown). Coupled to the bus can be a memory, storage device, a keyboard, a graphics adapter, a pointing device, and a network adapter. A display can be coupled to the graphics adapter. The processor may be any general-purpose processor such as an INTEL ×86, SUN MICROSYSTEMS SPARC, or POWERPC compatible-CPU. Alternatively, processing device 160 omits a number of these elements but includes a processor and interface for communicating with audio processing device 100. In an embodiment, processing device 160 receives unprocessed audio/music data 150 over signal line 130*c* from audio processing device 100. Processing device 160 then processes audio/music data 150, and returns the result to audio processing device 100 via signal line 130*c*. Output system 108 on audio processing device 100 then outputs the result 100, as a paper document 170 or electronic data 180. In another embodiment, audio processing device 100 and processing device 160 share processing load or interactively carry out complementary processing steps, sending data and instructions over signal line 130*c*.

Figure 2:
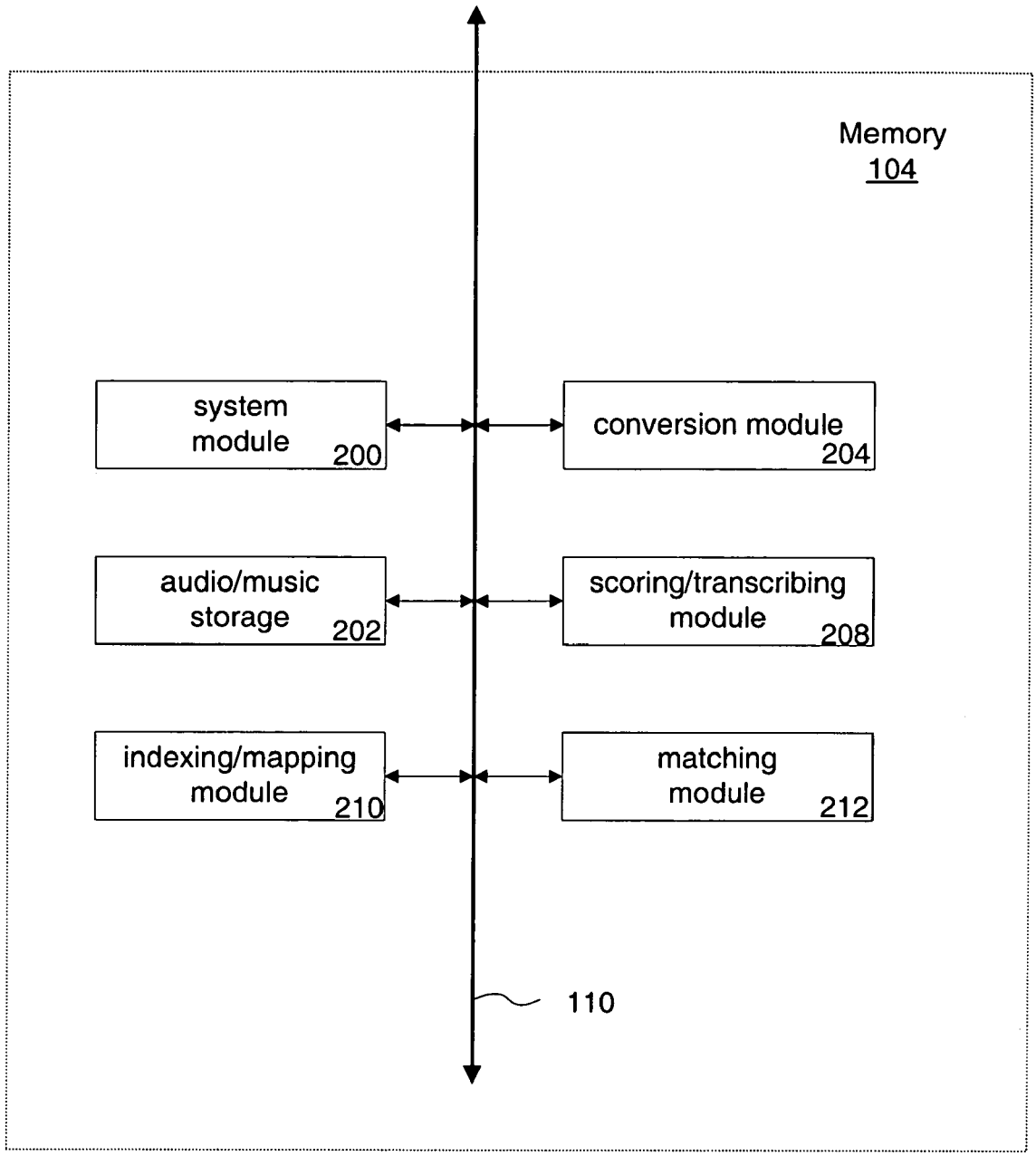
FIG. 2 is a block diagram of memory of the audio processing device of FIG. 1 in accordance with an embodiment of the invention.

FIG. 2 is a block diagram of memory 104 of the audio processor device 100 of FIG. 1 in accordance with an embodiment of the invention. Memory 104 is coupled to processor 106 and other components of audio processing device 100 by way of bus 110, and may contain instructions and/or data for carrying out any and/or all of the processing functions accomplished by audio processing device 100. In an alternate embodiment, memory 104 as shown in FIG. 2 is hosted on processing device 160 of FIG. 1, or another machine. Processor 106 of audio processing device 100 communicates with memory 104 hosted on processing device 160 through an interface that facilitates communication between processing device 160 and audio processing device 100 by way of signal line 103*c*. In addition, in embodiments of the invention certain elements 200–212 shown in memory 104 of FIG. 2 may be missing from the memory of audio processing device 100, or may be stored on processing device 160.

Memory 104 is comprised of main system module 200, assorted processing modules 204–212 and audio music storage 202 coupled to processor 100 and other components of audio processing device 100 by bus 110. Audio music storage 202 is configured to store audio/music data at various stages of processing, and other data associated with processing. In the embodiment shown, audio music storage 202 is shown as a portion of memory 104 for storing data associated with the processing of audio/music data. Those skilled in the art will recognize that audio music storage 202 may include databases and similar functionality, and may alternately be portions of the audio processing device 100. Main system module 200 serves as the central interface and control between the other elements of audio processing device 100 and modules 204–212. In various embodiments of the invention, main system module 200 receives input to process audio/music data, sent by processor 106 or another component via system bus 110. The main system module 200 interprets the input and activates the appropriate module 204–212. System module 200 retrieves the relevant data from audio music storage 202 in memory 104 and passes it to the appropriate module 204–212. The respective module 204–212 processes the data, typically on processor 100 or another processor, and returns the result to system module 200. The result then may be passed to output system 108, to be output as a paper document 170 or electronic data 180.

In an embodiment, system module 200 contains logic to determine what series of steps, in what order, should be carried out to achieve a desired result. For instance, system module 200 may receive instructions from system bus 110 indicating that the first two measures of a song should be saved to a cell phone card to be played as a ringtone based on an .mp3 file of the song. System module 200 can parse these instructions to determine that, in order to isolate the first two measures of the song, the file must first be converted from a .mp3 file to a MIDI file, then scored, and then the first two measures of the MIDI file should be parsed to be output to the cell phone card. System module 200 can then send commands to the various modules described below to carry out these steps, storing versions of the files in audio music storage 202.

Conversion module 204 is coupled to system module 200 and audio music storage 202 by bus 110. System module 200, having received the appropriate input, sends a signal to conversion module 204 to initiate conversion of audio/music data in a first format stored in audio music storage 202 to a file in a second format. Conversion module 204 facilitates the conversion between various electronic formats, for instance allowing for the conversion among MIDI file, .wav or .mp3 or other digital audio formats. As will be understood by those skilled in the art, any number of standard software packages could be used, with or without modification, to facilitate such conversions including Solo Explorer, freeware dowloadable at http://www.perfectdownloads.com/audio-mp3/other/download-solo-explorer.htm or Akoff's Music Composer product offered by Akoff Sound Labs at http,://www.akoff.com/, (.wav to MIDI conversion software), assorted products offered by Lead Technologies of Charlotte, N.C. (.wav to Windows Media or mp3 conversion), or ITunes™ offered by Apple Computer Inc. of Cupertino, Calif. (MIDI to mp3/wav conversion). Conversion module 204 may send calls over system bus 110 to these or other software modules to execute the relevant conversion, and direct the result to be saved to audio music storage 202. Conversion module may also be coupled with hardware to complete specific conversions for instance a digital-to-analog or analog-to-digital converter.

In another embodiment, conversion module 204 facilitates the conversion of an audio file received in analog form to a digital file before it is processed, using an analog-to-digital converter for instance. In such a case, conversion module 204 is coupled to an analog-to-digital converter, through system bus 110, and activates the converter to effect the conversion. In an embodiment, the digital file is returned to memory 104 from system bus 110, potentially for further processing. In another embodiment, conversion module 204 "converts" digital data to audio files. For instance, in an embodiment of the invention, audio processing device 100 receives a musical score stored in a postscript file sent to it over bus line 110. Conversion module 204, equipped with optical recognition capabilities for instance, parses the file to obtain the notes, and then generates a MIDI approximation using the notes. Standard software such as MusicScan sold by Hohner Media of Santa Rosa, Calif. (score to MIDI conversion) could be used or adapted to carry out one or more of these steps. The MIDI file could then be converted to a .wav or .mp3 file using the technologies described above. Alternatively, a playback module (not shown) could be activated by system module 200. The playback module would then retrieve the MIDI file from audio music storage 202 and pass it to system module 200, which would output it to a playback device (not shown) on audio processing device 100.

Scoring/transcribing module 208 is coupled to system module 200 and audio/music storage 202 by bus 110. In an embodiment, scoring or transcription is initiated when system module 200 receives instructions to score a digital music file or transcribe a speech file stored in audio/music storage 202. Scoring/transcribing module 208 could access a music file stored in audio/music storage 202 and create a digital file that contains a score of the musical notes in the file, for instance in postscript format. The postscript file could then be stored in audio/music storage 202. Module 208 could also transcribe a digitally recorded audio speech stored in audio/music storage 202, resulting in the creation of a file containing a script of the speech. These outputs could then be stored in audio/music storage 202 or another location in memory 104 or sent over system bus 110 to another location on or outside of audio processing device 100. To support the musical file to score conversion, any number of standard software packages including those offered by Notation Software, Inc. of Bellevue, Wash. (MIDI to score conversion), or Seventh String Software of England (audio recording to score conversion) could be used or adapted. The scoring output could be customized to a user's needs, and for instance reflect changes in key, tempo, phrasing or other parameters automatically performed by the scoring software. Similarly, the transcribing module could take live or recorded speech, apply speech recognition technology to the speech (such as that offered by Dragon Naturally Speaking 7, made by ScanSoft of Peabody, Mass. or ViaVoice® offered by IBM of White Plains, N.J.), and produce a text representation of the speech.

Indexing/mapping module 210 is coupled to system module 200 and audio/music storage 202 by bus 110. In an embodiment, system module 200, having received the appropriate input, sends a signal to conversion module 204 to index an audio/music file by segment. To carry out this instruction, indexing/mapping module 210 may access the file on audio/music storage 202 through system bus 110 and parse audio data contained in the file into audio segments such as a musical line, bar, stanza, or measure, or by song, discrete sound, speech by a speaker, or other segment. The various dividers could be determined by indexing/mapping module based on melodic phrasings, pauses, or other audio cues. In an embodiment, indexing/mapping module 210 creates a new file to store the indexing information and send the new file by system bus 110 to be stored in audio/music storage 202. In another embodiment, index/mapping module 210, responsive to digital commands sent by system module 200, accesses an .mp3 file stored in audio/music storage 202 and creates a waveform record of the .mp3 file. The waveform can be stored in memory 104 to an electronic document for instance in a graphical format that can later be sent to output system 108 to be printed to a paper output. Various techniques and interfaces for audio segmentation and audio mapping are discussed in more detail in U.S. Patent Application entitled, "Multimedia Print Driver Dialog Interfaces," to Hull et. al, filed Mar. 30, 2004, which is hereby incorporated by reference in its entirety.

Matching module 212 is coupled to system module 200 and audio/music storage 202 by bus 110. In an embodiment, system module 200, having received the appropriate input, sends a signal to matching module 212 to identify the pre-existing music file that best matches audio data provided by a user and stored in audio/music storage 202. The audio data to be matched could comprise a portion of a melody. The audio data could be sourced by a user recording part of a song on a radio with a digital audio recorder or a MIDI file created by a user recalling the riff of a song, for instance. In an embodiment, matching module 212 compares the audio data to pre-existing recordings or scores and attempts to make a match. Matching module 212 could include melody-matching software, for instance GraceNote CDDB or GraceNote MusicID provided by Gracenote of Emeryville, Calif., that has access to a licensed set of recordings. The recordings are preferably stored in a database hosted on a networked server (not shown). To access the recordings, matching module 212 sends a request to system module 200 to fetch the data from the server by way of a signal line, for instance an Ethernet connection. Based on data it receives, the melody matching software determines which recordings in the database provide the closest match to the audio data. In an embodiment, once a match is found, matching module 212 sends a message to system module 200 to output to a user a message identifying the matching recording and asking if the user would like a copy of the recording. This message could be sent over system bus 110 and displayed on an output interface of audio processing device 100 for instance. In an embodiment, if the user indicates that she would like a copy of the recording, a financial transaction to allow the user to pay for the recording is launched.

FIG. 3 shows an exemplary print dialog box 300 for use with audio processing device 100. The user can input information into the fields of the dialog box 300 to designate the user's preferences regarding layout, segmentation, etc. The dialog box 300 shown could be launched on a graphical display coupled to an audio processing device 100 whenever a user selects the print option from an application. Print dialog 300 includes some fields that are found in a standard print dialog box such as Printer field 304. However, print dialog 300 also displays fields that are not found within standard printer dialog boxes, such as Output Options field 314, Advanced Options field 310, and Preview field 312. As is found in standard print dialog boxes, the top of print dialog 300 includes the name (e.g., "Vesoul.mp3") of the audio/music file being printed. In Printer field 304, the user can select which printer will carry out the print job, and other options with regard to properties of the print job, printing as a image or file, printing order, and the like. Additionally, Printer field 304 displays the status of the selected printer, the type of printer, where the printer is located, and the like.

Output Options field 314 allows the user to choose how she would like the audio/music file to be output, and to what media. Input Data Type field 350 is automatically populated with the type of file that the user is attempting to print, assuming that the file type is recognized. Input Data Type field 350 of FIG. 3 indicates that the file is an .mp3 file. The user can then specify the data type of up to two outputs in Data Type Output fields 352, 356 although in other embodiments, more than two outputs can be designated. The menus (not shown) associated with each Data Type Output field 352, 356 allow the user to specify among various audio and music formats including .mp3, .wav, MIDI, score, transcription and the like. The second output field, Data Type Output 2 356 includes a "(NONE)" selection by which the user can indicate that she does not want a second output.

As shown in FIG. 3, the user has selected two outputs, a MIDI file and a waveform timeline. The Output Options field 314 also allows the user to designate what media it would like each output to be output to, using the Print Output to fields 354, 358. Using pull down menus, the user can select between different choices of output locations including memory stored on drives, a print tray, a playback device, an archive, or other location coupled to audio processing device 100. In an embodiment, a user can indicate that she would like the output to be sent to an email address. When this selection is made, an email interface is launched that allows the user to specify the sender and recipient email addresses and a text message attaching the output will be generated. As shown in FIG. 3, the user's choices, entered into the dialog box 300 direct a MIDI file version of the input file be output to a CD stored in the D:// drive 354 of the audio processing device 100 and a wave form rendering of the input file to be printed to a paper document and delivered to print tray 2 358 on audio processing device 100. An Indexing Type field 360 is also provided, in which the user can specify how it would like an output indexed, in addition to a Time Stamp field 362. As shown in FIG. 3, the user has selected a bar code index, and does not desire a time stamp to be placed on the output.

Advanced Options field 310 provides the user with options that are specific to the formatting and layout of audio data. In this embodiment, the user selects the segmentation type that the user would like to have applied to the audio data. In this embodiment of the invention, the user can click on the arrow in the Segmentation Type field 316, and a drop-down menu will appear displaying a list of segmentation types from which the user can choose. Examples of segmentation options include, but are not limited to, segmentation by speaker, melody match, measure, bar, musical line, stanza, song, or discrete sound. In the example, the user has not selected any segmentation type in the Segmentation Type field 316, so the segmentation type is shown as "NONE." Each segmentation type can have a confidence level associated with each of the events detected in that segmentation. For example, if the user has instructed an audio processing device 100 to segment the audio file by stanza, each identified stanza will have an associated confidence level defining the confidence with which a stanza was correctly detected. Within Advanced Options field 310, the user can define or adjust a threshold on the confidence values associated with a particular segmentation.

In one embodiment, the user can also make layout selections with regard to the data representation generated. The user sets, within the "Fit on" field 320, the number of pages on which an audio waveform timeline will be displayed. The user also selects, within the timeline number selection field 322, the number of timelines to be displayed on each page. Additionally, the user selects, within the Orientation field 324, the orientation (e.g., vertical or horizontal) of display of the timelines on the multimedia representation. For example, as shown in FIG. 3, the user can choose to have one timeline displayed on one page, horizontally, and this will display the entire audio waveform timeline 334 horizontally on a page. As another example, the user can choose to have the audio waveform timeline broken up into four portions that are displayed vertically over two pages (i.e., two timelines per page).

The Preview field 312 shows a preview of the wave form timeline to be output to print tray 2 according to the selections chosen by the user. In other embodiments, there are two preview fields to represent each of two different outputs. For electronic outputs, such as an .mp3 file, a generic representation of the memory medium on which the file is to be output, for instance a clip art depiction of a CD, may be shown. As shown, the preview includes the number of timelines per page selected by the user (3), and also identifies the name of the file being printed 310 ("Vesoul.mp3"). In addition, responsive to the user's choice of a bar code index, the output includes a dynamically linked bar code 364 reference to the musical file with which a user can later access the file.

In the embodiment of FIG. 3, there are also shown various buttons, including an Update button 326, a Page Setup button 328, an OK button 330, and a Cancel button 332. The image of the document shown in Preview field 312 will be updated to display any new changes the user has made within print dialog 300. When the user selects the OK button 330, the current user-defined preferences are sent to an output system to be output. If the user selects the Cancel button 332 at any point in the process, the creation of the print job ends and print dialog 300 disappears.

Figure 4:
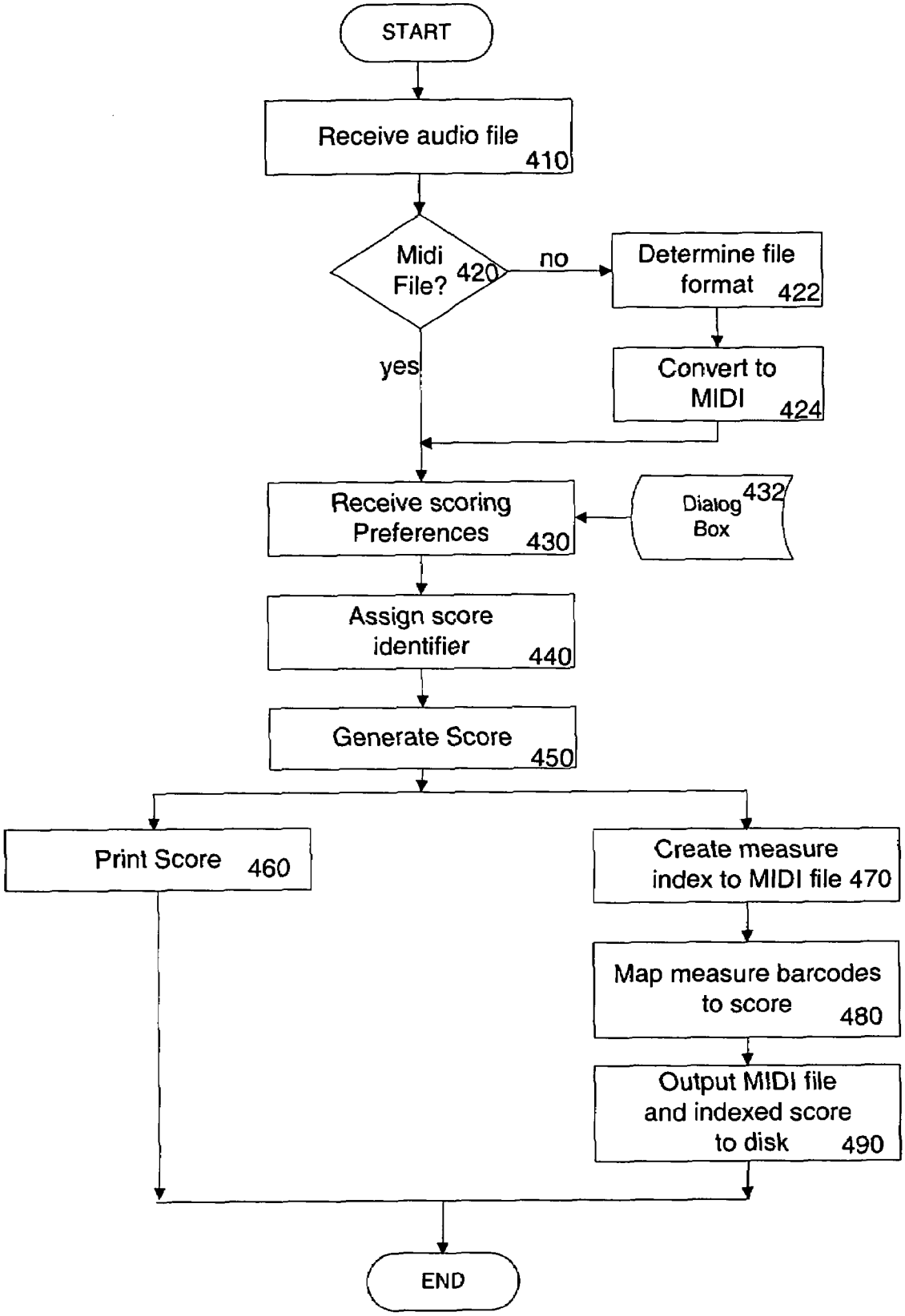
FIG. 4 is a flow diagram of steps of a preferred embodiment of an audio processing device.

Embodiments of the invention involve use of combinations of the modules within memory 104 described with reference to FIG. 2 to process audio/music data. FIG. 4 is a flow diagram of steps carried out by a preferred embodiment of audio processing device 100 using multiple elements 200–212 to generate the paper output depicted in FIG. 5. In an embodiment, the steps of FIG. 4 are carried out by audio processing device 100 of FIG. 1 installed with the memory of FIG. 2. However, other versions of audio processing device 100 with memory as described herein could also carry out these steps. The process shown in FIG. 4 begins when the audio processing device 100 receives 410 an audio file. A user sends the file to audio processing device 100 from a networked PC over an Ethernet connection, and it is stored to audio/music storage 202. Along with the file, the user sends instructions to generate an indexed score based on the audio file over a signal line to audio processing device 100 and the instructions are routed to system module 200 over system bus 110. System module 200 receives the instructions and initiates a series of steps to carry out the request.

First, system module 200 determines 420 whether the file is a MIDI file. If the file is determined not to be a MIDI file, then system module 200, with the help of detection module (not shown) determines 422 the format of the file, in this case, an audio file in .mp3 format. The system module 200 sends a command over system bus 110 to conversion module 204 to convert 424 the file from .mp3 to MIDI. Conversion module 204 accesses the file over system bus 110 in audio music storage 202, and creates a MIDI file that approximates the audio file. It sends the MIDI file to system module 200, which then stores it to audio music storage 202. If the audio file is a MIDI file or has been converted into one, system module activates a user interface module (not shown) instructing it to prompt the user for her scoring preferences 432. The user interface then sends data signals over system bus 110 representing a dialog box similar to the one depicted in FIG. 3 to the system module 200 to be output on the user's PC. Responsive to the dialog box 432, the user specifies the outputs she would like—a score and a MIDI file indexed by measure—and how she would like the output to be presented (on paper and burned to a CD) with reference to parameters such as the number of lines of music, the style of the notes, the frequency of bar codes, and the format of the bar codes. The system module receives the scoring preferences 430, and then stores them in audio music storage 202.

System module 200 then initiates the scoring process on the scoring/transcribing module 208. First, scoring/transcribing module 208 sets up a file to store the score, and assigns 440 a score identifier to the file, for instance a number. Scoring/transcribing module 208 then carries out conversion of the MIDI file to generate 450 a score. Scoring/transcribing module 208 saves the data to the score file and formats the score responsive to preferences entered by the user. Scoring/transcribing module 208 communicates to system module 200 that the score has been completed. System module 200 then sends the score file information to output system 108 with output instructions provided by the user to print the score to a paper document and the document is printed 460 accordingly. In parallel, system module 200 initiates the generation of the second output. It sends instructions to indexing/mapping module 210 to create 470 an index to the MIDI file by measure responsive to the score. Indexing/mapping module 210 accesses the MIDI file and score of the file, both stored in audio music storage 202, over system bus 110.

Indexing/mapping module 210 determines the beginning of each musical measure, based on the score, and creates 470 a measure index to the MIDI file that references the beginning and end of each measure. Responsive to instructions from system module 200, indexing/mapping module 210 assigns an identifier, for instance, a bar code pointer, to each of three measure segments. Indexing/mapping module 210 then accesses the original score, and maps 480 the bar codes to the score in the appropriate locations in the format requested by the user. Indexing/mapping module 210 decides the appropriate location for the barcodes, using a placement algorithm for instance as described in J. S. Doerschler and H. Freeman, "A rule-based system for dense-map name placement," *Communications of the ACM*, v. 35 No. 1, 68–79, 1992.

Figure 5:
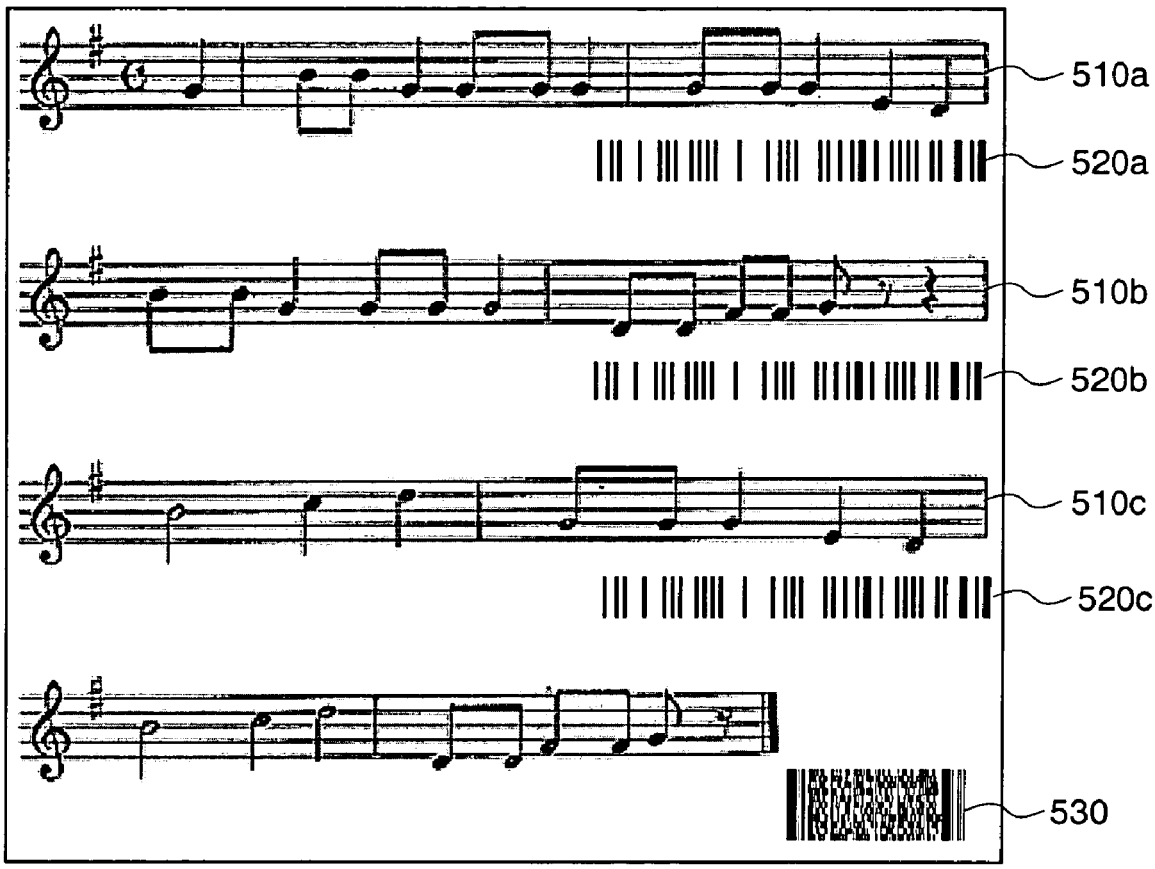
FIG. 5 shows an exemplary document output by an audio processing device.

An exemplary resulting product, a postscript file, is depicted in FIG. 5. As shown, the melody is divided into four two to three measure segments 510. The score indicates that the song is in G major, and dynamic pointers to the end and beginning of each segment are referenced by bar codes 520. The bar codes 520 point to specific sections in the MIDI file that contains the melody. A two-dimensional bar code 530 has also been created by indexing/mapping module 210 and placed in the file that identifies the entire MIDI file as a whole, and is output at the bottom of the score for ease of reference. In an embodiment, when a user later wants to hear portions of the melody, she prints out a copy of the postscript file. She then uses a decoding device (a two-dimensional bar code scanner) to access the MIDI data and listen to the selected portions of the file.

Returning to FIG. 4, after the indexed score has been created, indexing/mapping module 210 sends a message to system module 200 providing the filename of the indexed score. System module 200 sends the indexed score to output system 108, and instructs it to save 490 the indexed score dynamically linked to the MIDI file to a blank CD stored in a drive of audio processing device 100. At some later point, various files used to generate the outputs—including the .mp3 file and portions of the score—are marked to be deleted from memory 104. In another embodiment, the first measure of the MIDI file 510*a*, referenced by bar code 520*a*, is extracted and saved to audio/music storage 202. Output system 108 then outputs the short segment to a memory card to be inserted into a cell phone and used as a ring tone. In another embodiment, audio processing device 100 directly receives two files—the score and the MIDI file—and carries out an abbreviated version of the steps in FIG. 4 including steps 410, 470, 480, and 490.

Figure 6:
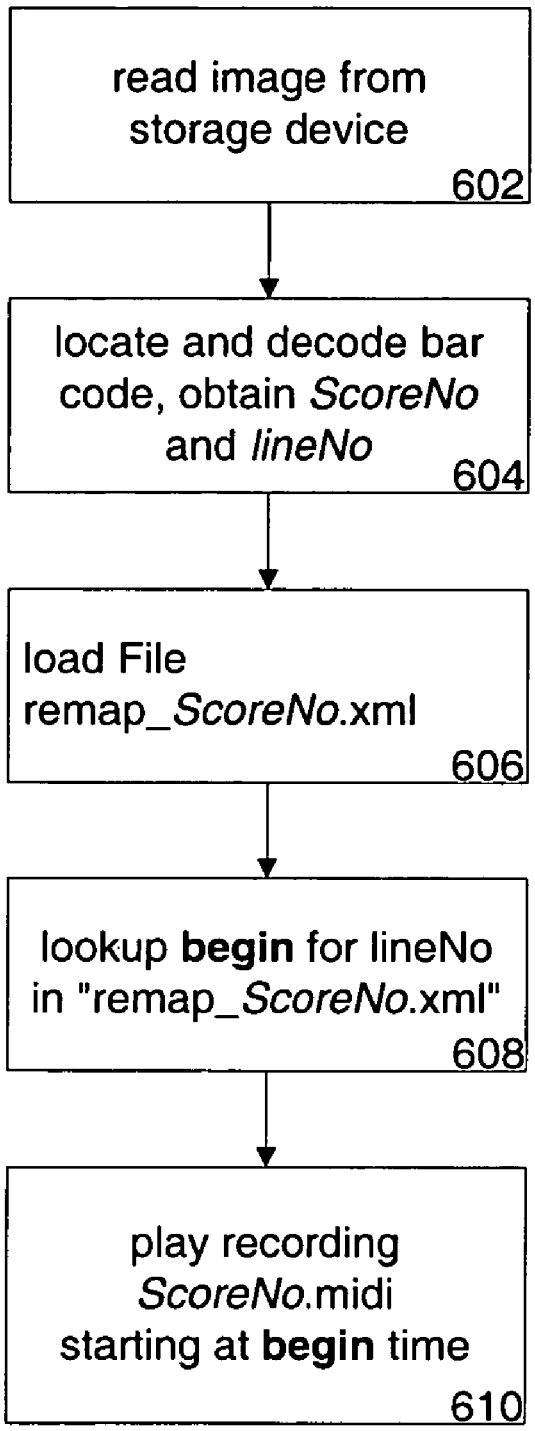
FIG. 6 is a flow diagram showing a preferred process for retrieving a file stored by an audio processing device.

FIG. 6 is a flow diagram showing how a portion of a score file stored by audio processing device 100 printer could be retrieved and read by an access device. For example, a CD contains an archive of musical clips and a barcode index to these clips stored in an image file. An access device (not shown) could comprise a standard PC with a CD drive coupled to a bar code reader by a signal line. To access the clips, the access device would first access the image of the barcode index from the CD in the CD drive of the PC 602. A user could print the image for ease of handling to a conventional printer coupled to a PC by a signal line. Next, the user locates 604 the relevant bar code. Using the bar code reader, the user uses the bar code reader to read the bar code, yielding a specific score number and the line number associated with the portion the user wants to access. The score with the correct score number (e.g., remap_ScoreNo.xml) is loaded 606, and the line number (e.g., remap_LineNo.xml) associated with the desired clip is used to locate the specific line and clip stored on the CD. Once these are located, the computer plays 610 the recording, starting with the begin time of the line closest to bar code that was scanned.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

We claim:

1. A method comprising:

receiving by a printer audio/music data in a first format, wherein the printer is a device configured to print to a printable tangible medium;

storing, in an audio/music storage module embedded within the printer, the audio/music data in the first format, wherein the audio/music data in the first format comprises music data;

processing by a conversion module embedded within the printer the audio/music data to convert the audio/music data from the first format to a second format;

mapping musical content from the music data to a file in the second format;

assigning an identifier to a segment of the music data; and outputting by the printer the processed audio/music data in the second format.

2. The method of claim 1, wherein the identifier comprises a pointer to a medium.

3. A method comprising:

receiving by a printer audio/music data in a first format, wherein the printer is a device configured to print to a printable tangible medium;

storing, in an audio/music storage module embedded within the printer, the audio/music data in the first format;

processing by a conversion module embedded within the printer the audio/music data to convert the audio/music data from the first format to a second format;

archiving the processed audio/music data;

indexing the archived audio/music data; and outputting by the printer the processed audio/music data in the second format.

4. The method of claim 3, wherein the step of indexing comprises assigning a bar code to the musical segment.

5. A method comprising:

receiving by a printer audio/music data in a first format, wherein the printer is a device configured to print to a printable tangible medium;

storing, in an audio/music storage module embedded within the printer, the audio/musicdata in the first format;

processing by a conversion module embedded within the printer the audio/music data to convert the audio/music data from the first format to a second format; and outputting by the printer processed audio/music data in the second format, wherein the processed audio/music data in the second format comprises a musical score.

6. The method of claim 5, further comprising processing the audio/music data responsive to commands provided by one from the group of:

a print dialog, PDL comments, a print driver, and a graphical user interface networked with the printer.

7. The method of claim 5, wherein the audio/music data further comprises audio speech.

8. The method of claim 7, further comprising recognizing the audio speech.

9. The method of claim 5, wherein the processed audio/music data comprises a file printable to a paper document.

10. The method of claim 5, wherein outputting the processed audio/music data comprises playing the audio/music data on a playback device.

11. The method of claim 5, wherein outputting the processed audio/music data comprises storing the audio/music data to a storage medium.

12. The method of claim 5, wherein the audio/music data in the first format comprises music data, and wherein the method further comprises:

mapping musical content from the music data to a file in the second format.

13. The method of claim 5, wherein the step of processing the audio/music data is performed in part by a device other than the printer and in part by the printer.

14. A method comprising:

receiving by a printer audio/music data in a first format, wherein the printer is a device configured to print to a printable tangible medium;

storing, in an audio/music storage module embedded within the printer, the audio/music data in the first format;

processing by a conversion module embedded within the printer the audio/music data to convert the audio/music data from the first format to a second format; and outputting by the printer the processed audio/music data in the second format, wherein outputting the processed audio/music data comprises sending the audio/music data over a network.

15. The method of claim 14, further comprising processing the audio/music data responsive to commands provided by one from the group of: a print dialog, PDL comments, a print driver, and a graphical user interface networked with the printer.

16. The method of claim 14, wherein the audio/music data comprises audio speech.

17. The method of claim 14, wherein the processed audio/music data comprises a file printable to a paper document.

18. The method of claim 14, wherein outputting the processed audio/music data further comprises playing the audio/music data on a playback device.

19. The method of claim 14, wherein outputting the processed audio/music data further comprises storing the audio/music data to a storage medium.

20. The method of claim 14, wherein the step of processing the audio/music data is performed in part by a device other than the printer and in part by the printer.

21. A method comprising:

receiving by a printer audio/music data in a first format, wherein the printer is a device configured to print to a printable tangible medium:

storing, in an audio/music storage module embedded within the printer, the audio/music data in the first format, wherein the audio/music data in the first format comprises music data;

comparing a melody of the music data to a plurality of melodies;

matching the melody of the music data to one of the plurality of melodies;

processing by a conversion module embedded within the printer the audio/music data to convert the audio/music data from the first format to a second format; and outputting by the printer the processed audio/music data in the second format.

22. A method comprising:

receiving by a printer audio/music data in a first format, wherein the printer is a device configured to print to a printable tangible medium;

storing, in an audio/music storage module embedded within the printer, the audio/music data in the first format, wherein the audio/music data in the first format comprises music data;

parsing the music data by musical segment;

processing by a conversion module embedded within the printer the audio/music data to convert the audio/music data from the first format to a second format; and outputting by the printer the processed audio/music data in the second format.

23. The method of claim 22, wherein the musical segment comprises one from the group of: a piece, song, stanza, movement, bar, chorus, and riff.

24. The emthod of claim 22, wherein the processed audio/music data comprises a file printable to a paper document.

25. The method of claim 22, wherein the step of processing the audio/music data is performed in part by a device other than the printer and in part by the printer.

26. A method comprising:

receiving by a printer audio/music data in a first format, wherein the printer is a device configured to print a printable tangible medium;

storing, in an audio/music storage module embedded within the printer, the audio/music data in the first format;

indexing the audio/music data according to its audio content;

processing by a conversion module embedded within the printer the audio/music data to convert the audio/music data from the first format to a second format; and outputting by the printer the processed audio/music data in the second format.

27. The method of claim 26, wherein the step of processing the audio/music data is performed in part by a device other than the printer and in part by the printer.

28. The method of claim 26, wherein the processed audio/music data comprises a file printable to a paper document.

29. A printer for outputting a processed audio/music file comprising:

an interface for receiving audio/music data in a first format;

an audio/music storage module embedded within the printer for storing the received audio/music data;

a processor embedded within the printer and communicatively coupled to the audio/music storage module for processing the audio/music data;

a conversion module embedded within the printer and communicatively coupled to the processor and the audio/music storage module for converting the audio/music data from the first format to an electronic format and to a printable format; and an output system embedded within the printer for outputting the processed audio/music data in the electronic format and for printing the processed audio/music data in the printable format to a tangible printable medium, wherein the output system comprises a disk drive capable of outputting electronic data.

30. The printer of claim 29, wherein the first format comprises an analog music file.

31. The printer of claim 29, further comprising a command module for automatically determining the conversion pathway of the audio/music data in the first format to a file in an output format wherein the conversion pathway comprises at least a conversion of the audio/music data in the first format to a second format, and a conversion from the second format to the output format.

32. A printer for outputting a processed audio/music file comprising:

an interface for receiving audio/music data in a first format;

an audio/music storage module embedded within the printer for storing the received audio/music data;

a processor embedded within the printer and communicatively coupled to the audio/musicstorage module for processing the audio/music data;

a conversion module embedded within the printer and communicatively coupled to the processor and the audio/music storage module for converting the audio/music data from the first format to an electronic format and to a printable format; and an output system embedded within the printer for outputting the processed audio/music data in the electronic format and for printing the processed audio/music data in the printable format to a tangible printable medium, wherein the output system comprises a transmitter to broadcast audio/music data.

33. The printer of claim 32, wherein the first format comprises an analog music file.

34. A printer for outputting a processed audio/music file comprising:

an interface for receiving audio/music data in a first format;

an audio/music storage module embedded within the printer for storing the received audio/music data;

a processor embedded within the printer and communicatively coupled to the audio/music storage module for processing the audio/music data;

a conversion module embedded within the printer and communicatively coupled to the processor and the audio/music storage module for converting the audio/music data from the first format to an electronic format and to a printable format, wherein the conversion module is configured to automatically convert the sudio/music file from the first format into the electronic format or the printable format by converting the sudio/music file from the first format into a second format and from the second format into the electronic format and the printable format; and an output system embedded within the printer for outputting the processed audio/music data in the electronic format and for printing the processed audio/music data in the printable format to a tangible printable medium.

35. The printer of claim 34, wherein the electronic format comprises one from the group of an: electronic score, .wav, .MIDI, and .mp3.

36. A printer for outputting a processed audio/music file comprising:

an interface for receiving audio/music data in a first format;

an audio/music storage module embedded within the printer for storing the received audio/music data;

a processor embedded within the printer and communicatively coupled to the audio/music storage module for processing the audio/music storage module for converting the audio/music data from the first format to an electronic format and to a printable format;

a scoring module for creating a score based on the audio/music data; and an output system embedded within the printer for outputting the processed audio/music data in the electronic format and for printing the processed audio/music data in the printable format to a tangible printable medium.

37. The printer of claim 36, wherein the output system is configured to output the processed audio/music data to at least one of the group of: a printed document, an analog file, an optical disk, a portable device memory, a networked server, and a networked display.

38. The printer of claim 36, wherein the output system is configured to output the processed audio/music data to a digital format and to at least one of the group of: a printed document, an analog file, and a networked display.

39. The printer of claim 36, wherein the first format comprises an analog music file.

40. The printer of claim 36, further comprising a command module for automatically determining the conversion pathway of the audio/music data in the first format to a file in an output format wherein the conversion pathway comprises at least a conversion of the audio/music data in the first format to a second format, and a conversion from the second format to the output format.

41. A printer for outputting a processed audio/music file comprising:

an interface for receiving audio/music data in a first format;

an audio/music storage module embedded within the printer for storing the received audio/music data;

a processor embedded within the printer and communicatively coupled to the audio/music storage module for processing the audio/music data;

a parsing module for segmenting the audio/music file responsive to its audio content;

a conversion module embedded within the printer and communicatively coupled to the processor and the audio/music storage module for converting the audio/music data from the first format to an electronic format and to a printable format; and an output system embedded within the printer for outputting the processed audio/music data in the electronic format and for printing the processed audio/music data in the printable format to a tangible printable medium.

42. The printer of claim 41, wherein the first format comprises an analog music file.

* * * * *

UNITED STATES PATENT AND TRADEMARK OFFICE

CERTIFICATE OF CORRECTION

PATENT NO. : 7,314,994 B2
APPLICATION NO. : 10/813849
DATED : January 1, 2008
INVENTOR(S) : Jonathan J. Hull et al.

It is certified that error appears in the above-identified patent and that said Letters Patent is hereby corrected as shown below:

Column 15,
Line 66, please delete "audio/musicdata" and replace with --audio/music data--.
Column 16
Line 4, please add --the-- before the word "processed".
Column 17
Line 4, please delete "medium:" and replace with --medium;--.
Line 43, please add --to-- after the word "print".
Column 18
Line 31, please delete "audio/musicstorage" and replace with --audio/music storage--.
Line 61, please delete "sudio/music" and replace with --audio/music--.
Line 62, please delete "sudio/" and replace with --audio/--.
Column 19
Lines 12-16, please delete
"a processor embedded within the printer and communicatively coupled to the audio/music storage module for processing the audio/music storage module for converting the audio/music data from the first format to an electronic format and to a printable format;"

and replace with

--a processor embedded within the printer and communicatively coupled to the audio/music storage module for processing the audio/music data;
a conversion module embedded within the printed and communicatively coupled to the processor and the audio/music storage module for converting the audio/music data from the first format to an electronic format and to a printable format;--.

Signed and Sealed this

Sixth Day of May, 2008

JON W. DUDAS
*Director of the United States Patent and Trademark Office*